United States Patent [19]

Martin

[11] 4,126,314

[45] Nov. 21, 1978

[54] APPARATUS FOR PLAYING A GOLF AND/OR PUTTING GAME

[76] Inventor: Robert Martin, 1 Pannells, Terrace La., Freshwater Bay, Isle of Wight, England

[21] Appl. No.: 780,355

[22] Filed: Mar. 23, 1977

[30] Foreign Application Priority Data

Mar. 31, 1976 [GB] United Kingdom ..... 13035/76

[51] Int. Cl.[2] ..... A63F 3/00

[52] U.S. Cl. ..... 273/245; 273/176 L; 273/142 HA; 273/32 H

[58] Field of Search ..... 273/134 CG, 87 R, 87 G, 273/87.2, 87.4, 176 L, 143, 32 R, 142 HA, 32 H

[56] References Cited

U.S. PATENT DOCUMENTS

| | | | |
|---|---|---|---|
| 1,316,048 | 9/1919 | Massena | 273/134 CG |
| 1,728,630 | 9/1929 | Sanderson | 273/134 CGX |
| 1,800,285 | 4/1931 | Dowling | 273/134 CG |
| 2,157,172 | 5/1939 | Hays | 273/134 CG |
| 2,618,482 | 11/1952 | Grogan | 273/134 CG |
| 3,260,526 | 7/1966 | Seitz | 273/134 CG |
| 3,401,561 | 11/1968 | Ekstrand | 273/134 CG |

*Primary Examiner*—George J. Marlo
*Attorney, Agent, or Firm*—Fay & Sharpe

[57] ABSTRACT

Apparatus for playing a golf game comprises a panel behind and to which a club selector disc, a masking member and a stroke result indicator disc are mounted for rotation about a common axis. The panel has therein a window and an arcuate slot. The stroke result indicator disc has a plurality of holes therearound, some of which are accessible at any one time through the arcuate slot in the panel. The indicator disc has a plurality of sets of markings spaced therearound, the markings of each set representing different results for a stroke imparted to a golf ball by a golf club and being positioned so that each is behind the panel window when the stroke result indicator member is at an associated angular position with respect to the panel. The masking member is positioned between the panel and the stroke result indicator disc and has a window therein and a representation of a golf ball thereon. The club selector disc is positioned between the panel and the masking member and has a plurality of windows therein selectively positionable behind the panel window in accordance with the club or type of club to be used. To play a stroke, the club selector disc is positioned in accordance with the club chosen whereby an associated one of the windows therein is behind the panel and over a corresponding one of the sets of stroke result markings. The masking member is moved to a position in which it masks the panel window, the representation of a golf ball then being visible through the panel window. In this position, the masking member partially obstructs the arcuate slot in the panel. To make a stroke, a pointed implement such as a pencil is inserted from in front of the panel through the arcuate slot and into one of the accessible holes in the stroke result indicator disc and moving smartly along the slot. The implement hits the masking member during its travel, simulating the ball being hit by sweeping the representation thereof out of sight. When the implement reaches the end of the slot the window in the masking member is behind that in the panel and a previously unknown marking is visible through the various windows to indicate the result of the stroke. In a modification, the club selector disc and all but one of the sets of markings are dispensed with.

11 Claims, 7 Drawing Figures

APPARATUS FOR PLAYING A GOLF AND/OR PUTTING GAME

BACKGROUND OF THE INVENTION

This invention relates to apparatus for playing a golf and/or putting games.

A disadvantage of known golfing games is that they are very different from the actual game of golf in that they rely mainly on chance and do not enable an experienced golfer to fully employ his skill, judgement and knowledge. There is therefore a need for a golfing game which simulates playing of the actual game as closely as possible, in particular to provide enjoyment to golfers who by reason of ill-health, age or other reason are unable to play golf or at least to play it as often as they would like.

It is an object of the present invention to provide a golf and/or putting game which simulates as closely as possible the real game.

A more specific object of the invention is to provide a golf and/or putting game in which making a stroke and the realisation of the result of the stroke resembles closely the actual game.

A further object of the invention comprises the provision of a golf and/or putting game in which the player can select a club to use and, after making a stroke, experience a result appropriate to the club chosen.

Another object of the invention is to provide a golf and/or putting game in which the player can employ his knowledge and experience in deciding how to play a shot.

Yet another object of the invention consists in the provision of a golf and/or putting game which can be adjusted to suit the handicap of the player concerned, whereby the element of chance involved in the result of a stroke corresponds closely to the player's actual or deemed handicap.

SUMMARY OF THE INVENTION

According to the invention, apparatus for playing a golf and/or putting game comprises a panel having a window therein, a stroke result indicator member rotatably mounted to and behind the panel and having spaced around its axis of rotation a set of markings which represent different results for a stroke imparted to a golf ball by a golf club, the markings being positioned so that each is behind the window in the panel when the stroke result indicator member is at an associated angular position with respect to the panel, a masking member positioned between the panel and the stroke result indicator member and movable between a first position in which it masks the window in the panel and a second position in which it does not mask the window in the panel, and stroke simulating means enabling manual rotation of the stroke result indicating member from in front of the panel to a stop position in which one of the markings is behind the window in the panel, the masking member being arranged to be moved to the second position as the stroke result indicating member is moved to the stop position whereby said one marking will be visible.

To simulate the different amounts of swing that can be imparted to the ball, the stroke simulating means is preferably arranged to enable manual rotation of the stroke result simulating means from any of a plurality of positions to the stop position.

Each player preferably has a respective apparatus as set forth above (although one apparatus could be shared); and the game is played with the aid of a representation of a golf course or part of a golf course. Although the representation can be only schematic, it is preferably a representational reproduction of a real or imaginary golf course or part thereof.

BRIEF DESCRIPTION OF THE DRAWINGS

A preferred embodiment of the invention will now be described, in more detail, by way of example, with reference to the accompanying drawings, in which.

DETAILED DESCRIPTION OF THE PREFERRED EMBODIMENT

Figure 1:
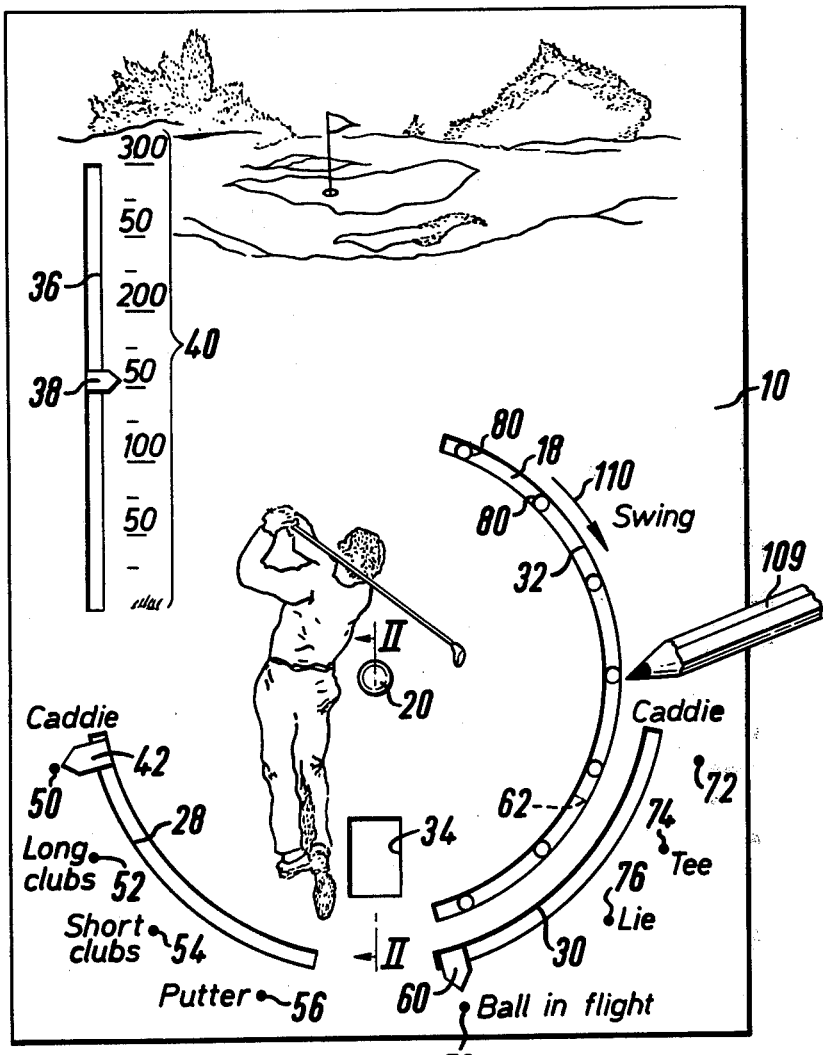
FIG. 1 is a top plan view of an apparatus embodying the invention.
Figure 2:
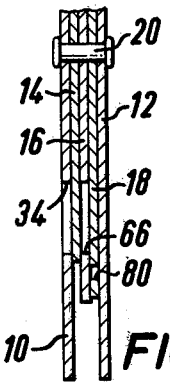
FIG. 2 is a partial sectional view of the apparatus taken along the line II—II in FIG. 1 with the thickness of various constituent members thereof exaggerated for clarity of illustration.
Figure 4:
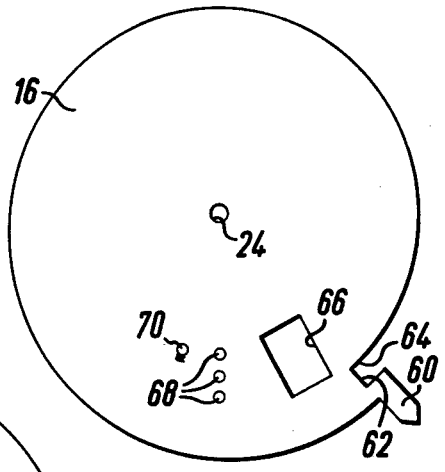
FIG. 4 is a plan view of a masking member forming part of the apparatus shown in FIGS. 1 and 2.
Figure 3:
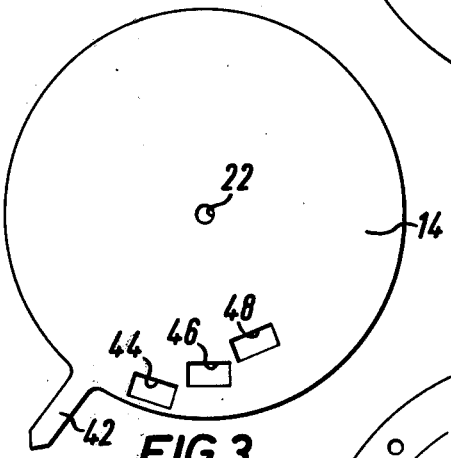
FIG. 3 is a plan view of a club selector disc forming part of the apparatus shown in FIGS. 1 and 2.

The apparatus shown in FIGS. 1 and 2 is for playing a golf game and comprises rectangular front and back panels 10 and 12, respectively. A club selector disc 14 (FIG. 3), a masking member 16 (FIG. 4) and a stroke result indicator disc 18 (FIG. 5) are sandwiched between the panels 10 and 12 as shown in FIG. 2. A rivet 20 or the like extends between the panels 10 and 12 and through holes 22, 24, 26 in the members 14, 16 and 18, respectively, whereby the members 14, 16 and 18 are individually rotatable with respect to the panels 10 and 12, which are fixed together, about the axis of the rivet 20.

The panels 10 and 12 and the members 14, 16 and 18 are of any suitable sheet material, for instance paperboard or plastics. Their thicknesses are exaggerated in FIG. 2 for clarity of presentation.

Referring to FIG. 1, the front panel 10 has therein three arcuate slots 28, 30, 32, each centred on the axis of the rivet 20; a window 34 defined by a rectangular aperture; and a straight slot 36. A pointer 38 is slidable along the slot 36 to be positioned adjacent any one of a plurality of markings 40 which represent distances of 0 to 300 yards in increments of 25 yards.

The club selector disc 14 (FIG. 3) has a pointer 42 protruding from its periphery and extending through the arcuate slot 28 in the front panel 10. The club selector disc 14 also has therein windows 44, 46 and 48, defined by apertures, which are mutually spaced apart both radially and circumferentially of the disc. By moving the pointer 42 along the slot 28, any one of the windows 44, 46 and 48, or a non-apertured part of the disc 14, can be positioned behind the window 34 in the front panel 10. More specifically: when the pointer 42 is adjacent a "caddie" marking 50 on the front panel 10 a non-apertured portion of the disc 14 will be behind the window 34; when the pointer 42 is adjacent a "long clubs" marking 52 on the panel 10 the window 48 will be behind the window 34; when the pointer 42 is adjacent a "short clubs" marking 54 on the panel 10 the window 46 will be behind the window 34; and when the pointer 42 is adjacent a "putter" marking 56 on the panel 10 the window 44 will be behind the window 34.

The masking member 16 (FIG. 4) has an approximately spiral periphery and has a pointer 60 protruding from the region of its periphery having the largest radius and extending through the arcuate slot 30 in the front panel 10. At the region of its periphery having the smallest radius the member 16 is provided with a substantially radially extending abutment edge 62 at the bottom of a cut-out recess 64. The member 16 is further provided with a window 66 of substantially the same size as the window 34 in the front panel 10, three radially spaced "lie" markings 68 indicating a ball lying on a golf course, and a "tee" marking 70 indicating a ball positioned ready for teeing-off. When the pointer 60 is positioned adjacent a "caddie" marking 72 on the front panel 10, a non-apertured and non-marked part of the member 16 is behind the window 34 in the front panel. When the pointer 60 is adjacent a "tee" marking 74 on the front panel 10 the "tee" marking 70 is behind the window 34. When the pointer 60 is adjacent a "lie" marking 76 on the panel 10 the "lie" markings 68 are all behind the window 34. When the pointer 60 is adjacent a "ball in flight" marking 78 on the panel 10 the window 66 is behind the window 34 and in correspondence therewith.

The stroke result indicator disc 18 (FIG. 5) has a plurality of holes 80 equally spaced therearound on equal radii. The radius of the holes 80 is the same as that of the arcuate slot 32 in the front panel 10 so that some of the holes 80 are behind and accessible through the slot 32. To ensure that the disc 14 and member 16 do not mask the holes 80 behind the slot 32, the radii of the parts of the peripheries of the disc 14 and member 16 that can be disposed in the same sector as the slot 32 are less than the radius on which the holes 80 are disposed.

For a reason which will be apparent from the description of operation given below, the radius on which the holes 80 are disposed is the same as that of the abutment edge 62 on the masking member 16.

Figure 5:
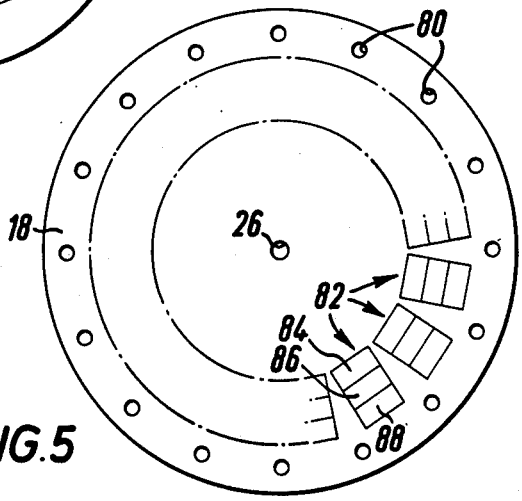
FIG. 5 is a plan view of a stroke result indicator disc forming part of the apparatus shown in FIGS. 1 and 2.

Groups 82 of three markings, the number of groups being equal to the number of holes 80, are equally spaced circumferentially around the stroke result indicator disc 18 as shown in FIG. 5. Each group 48 of three markings comprises a long club stroke result marking 84, a short club stroke result marking 86, and a putting stroke result marking 88.

Different long club stroke result markings 84 follow one another at random around the disc 18. The individual markings 84 indicate the accuracy of a stroke of a selected distance in up to two increments of 25 yards beyond or short of and/or to the left or right of a target, e.g. a marking "2' under, 2' slice" indicates 50 yards short and 50 yards to the right, a marking "2' over, 1' hook" indicates 50 yards over and 25 yards to the left, and a marking "1' over" indicates that the shot is 25 yards over and in line. The maximum error is therefore two increments under or over and two increments hook or slice (left or right), whereby the markings 84 are selected from 25 possible positions arranged in a square $5 \times 5$ array centred on the target. To maximise resemblance to real golf, the markings can be selected or programmed to simulate a particular handicap. For instance, it is estimated that out of 25 strokes a player with a handicap of 12 will make eight good strokes (on target), nine moderately good strokes (one 25-yard increment over or under and/or one 25-yard increment to the left or right) and eight poor strokes (two increments over or under and/or two increments to the left or right). Preferably, therefore, there are 25 markings 84 (in which case there would be 25 holes 80), and to simulate a handicap of 12 there will be eight "stroke" (on target) markings, nine different moderately good stroke markings and eight different poor stroke markings. Different handicaps from 0 to 24 can be simulated by varying the markings between the extremes of 25 target "stroke" markings (0 handicap) and 25 poor stroke markings (24+ handicap), the "quality profile" of the markings to simulate a particular handicap being reasonably accurately predictable. Further, a tendency to hook or slice can be simulated by providing more markings 84 indicating the ball lying to the left of the target than the right; or vice versa.

Different short club stroke result markings 86 and putting stroke result markings 88 follow one another at random around the disc 18 in a similar manner. The short club stroke result markings 86 can be similar to the long club stroke result markings 84, though the range of error may be somewhat less, for example restricted to one increment under or over and one increment to the left or right. The short club stroke result markings 86 can include "duff" markings indicating that the ball has not moved. The putting stroke result markings 88 can be even simpler, for intance restricted to a random selection of the four markings: "in", "store dead", "1 yard over" and "1 yard short".

Figure 6:
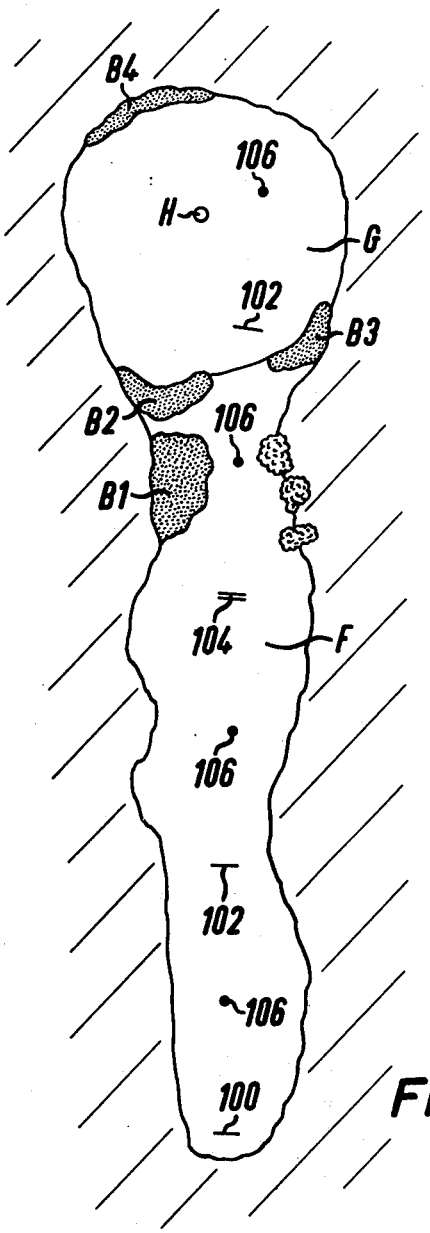
FIG. 6 is a partial plan view of a playing board, showing one hole of a golf course.

FIG. 6 is a part view of a representational reproduction on a reduced scale of a real or imaginary golf course. FIG. 6 shows one hole of the course, the hole comprising a fairway F, a green G having a hole H, and bunkers B1 to B4. The teeing-off position is marked by a line 100. Spaced apart along the line from the teeing-off position 100 to the green G are markings comprising single lines 102, a double line 104 and dots 106. The dots 106, single lines 102 and double line 104 represent, respectively, intervals of 25, 50 and 100 yards. Thus, it will be seen that the illustrated hole is a 175 yard hole.

The complete equipment for playing a golf game comprises the representational golf course shown in FIG. 6, which may be a foldable panel or board or a set of individual folios, an apparatus as shown in FIGS. 1 to 5 for each of the players (although one such apparatus could be shared), and a respective marker (e.g. a miniature golfer) for each player to show his position on the course. The apparatus shown in FIGS. 1 to 5 will hereinafter be referred to as a "golf bag".

The game is played in a manner exactly similar to real golf, and in particular in accordance with the rules of real golf, save where dictated otherwise by the fact that the game is a sinulacrum.

To play the hole shown in FIG. 6, the players survey the hole in exactly the same way as their outdoor counterparts, studying the fairway and observing the various hazards. The player to start decides where he wishes the ball to land and sets the distance he wishes to play by moving the pointer 38 on his golf bag to the appropriate marking 40. Since driving off will require a long club (i.e. a wood or iron), he moves the pointer 42 on his golf bag from the "caddie" marking 50 to the "long clubs" marking 52. This rotates the club selector disc 14 such that the window 48 therein is behind the window 34 in the front panel. He then moves the pointer 60 on his golf bag from the "caddie" marking 72 to the "tee" marking 74. This rotates the masking member 16 such that the "tee" marking 70 is visible through the windows 34 and 48 and such that the abutment edge 62 is disposed behind the arcuate slot at the position shown in FIG. 1 by a dotted line. The player then makes his swing by inserting a thin, pointed rod (e.g. the point of a pencil 109 shown in FIG. 1) in any one of the five holes 80 still visible through the slot 32 and rotating it smartly along the slot 32 in the direction of an arrow 110 marked on the front panel 10 (see FIG. 1), causing the stroke result indicator 18 to rotate. Contact of the pencil 109, which simulates a golf club, with the abutment edge 62 is equivalent to the impact of the club with the ball and rotates the masking member 16, sweeping the ball (as represented by the "tee" marking 70) out of sight. When the rod meets the bottom end of the slot 32 rotation of the member 16 and disc 18 stops. The pointer 60 is then adjacent the "ball in flight" marking 78 and the window 66 in the member 16 is then behind the windows 48 and 34, whereby a previously unknown one of the long club stroke result markings 84 on the disc 18 is visible through the windows 34, 48 and 66 to indicate the result of the stroke. The player then moves his marker to the "lie" position of the ball resulting from his stroke as determined by the distance he selected and the result marking 84.

Playing the game calls for the exercise of judgment as is needed in the actual game of golf. Suppose, for example, that on his first swing the player elected to hit the ball for a distance of 175 yards so as to get it directly onto the green. If the result of the swing as indicated by the marking 84 is "stroke", i.e. a straight hit over the desired distance, the player has done well. However, if the result is 25 yards or 50 yards over, the player is in the rough beyond the green G. On the other hand, should the player elect to make his first hit 150 yards, he will be in bunker B3 if he has two 25-yard increments of slice and in bunker B1 if he is 25 yards short with one increment of hook. The element of chance present in real golf is not lacking. Supposing, in making an initial stroke of 150 yards, the player gets the correct length but hooks the ball by one 25 yard increment, this will not matter since the ball will still be on the green G.

The game then continues with the other player (assuming only two players are involved) driving off in the same manner. The first player then prepares for his second stroke. He again surveys the fairway and assesses his distance to the hole H, taking into account the hazards in between. If he is still a long distance from the green he may again use a long club. If he is near enough to the green to pitch up he will select a short club (e.g. a pitching wedge). If he is hazarded, e.g. in a bunker or deep rough, he is obliged to use a short club, e.g. a sand iron or wedge. If he is on the green G he will use a putter. He moves the pointer 60 to the "lie" marking 76, whereby the "lie" markings 68 on the masking member are behind the window 34, and moves the pointer 42 to the selected one of the markings 52, 54 and 56, whereby a corresponding one of the windows 44, 46 and 48 will be behind the window 34 and a corresponding one of the "lie" markings 68 will be visible. He then makes his stroke as before, one of the markings 84, 86, 88, depending on the club setting, indicating the result. The game continues in this manner, as in real golf, till both players have gone round the course.

Figure 7:
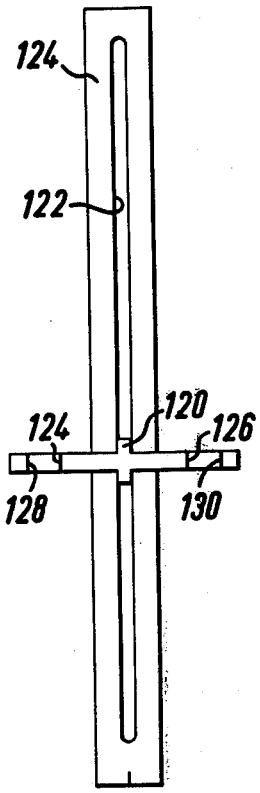
FIG. 7 is a plan view of a device for ascertaining where a ball lies on an unmarked playing board as a result of a particular stroke.

FIG. 7 shows a device for determining where a ball has fallen for use in the case of a golf course not having distance markings. A position indicating member 120 is movable along a slot 122 in an elongate member 124. To find where on a hole of the course a ball lies, as the result of a particular stroke, the position indicating member 120 is moved along the slot 122 until it is positioned adjacent the appropriate one of a plurality of graduations (not shown) arranged along the slot. If no hooking or slicing has occurred, the ball is deemed to be at a position on the axis of the slot 122 where the member 120 is disposed. If hooking or slicing has occurred, it is deemed to be spaced to one side or the other of such position. Markings 124, 126 indicate one increment of hook and one increment of slice, respectively, whereas markings 128, 130 indicate two increments of hook and slice, respectively.

The invention can, of course, be embodied in other ways than that described by way of example. For instance, in some cases, as in real golf, it may be advantageous to deliberately hook or slice a ball. In this case, the apparatus of FIGS. 1 to 5 can be provided with a small disc (not shown) arranged outside of the front panel 10. This disc is rotated to show whether the player has elected to drive straight, to hook or to slice. If he has elected to hook or slice, the extra disc may furthermore be arranged to indicate whether one increment or two increments of hook or slice is chosen.

The apparatus shown in FIGS. 1 to 5 could be further modified by replacing the linear distance selection arrangement comprised by the slot 36, slidable pointer 38 and marking 40 with a distance selection disc mounted outside of the front panel 10 and rotatable about the axis of the rivet 20. The disc would have the distances marked around its periphery whereby a particular distance could be selected by rotating the disc till the associated marking is in a reference position, e.g. adjacent the window 34.

A further modification of the apparatus of FIGS. 1 to 5 comprises replacing the rivet by a screw and nut arrangement whereby the apparatus can be disassembled, for instance to replace the stroke result indicator or disc 18 to change handicap or to obviate any unfair advantage a player might have obtained by memorising the order of the result markings thereon.

In a simplified modification of the apparatus shown in FIGS. 1 to 5, the club selector disc could be removed whereby a simpler game, e.g. putting only, could be played. In this case the stroke result indicator disc 18 would have only one set of stroke result markings. In such a modification three of the apparatuses could be combined on a single front panel 10 and back panel 12, the stroke result disc of each apparatus bearing a respective one of the sets of markings 84, 86 and 88, whereby the combined apparatus could be used to play a game in the same way as the apparatus of FIGS. 1 to 5.

Although in the illustrated apparatus there are three club selections, the number of club selections can be increased or decreased. For instance, there could be 14 different club selections corresponding to the 14 standard golf clubs, in which case there would have to be 14 windows in the club selector disc 14 and 14 corresponding sets of markings on the stroke result indicator disc 18.

What is claimed is:

1. Apparatus for playing a golf and/or putting game, said apparatus comprising:

(a) a panel having a window therein;

(b) a stroke result indicator member rotatably mounted to and behind said panel and having spaced around its axis of rotation a set of markings which represent different results for a stroke imparted to a golf ball by a golf club, said markings being positioned so that each is behind said window in said panel when said stroke result indicator member is at an associated angular position with respect to said panel;

(c) a masking member positioned between said panel and said stroke result indicator member and movable between a first position in which it masks said window in said panel and a second position in which it does not mask said window in said panel; and (d) stroke simulating means enabling mannual rotation of said stroke result indicating member from in front of the said panel to a stop position in which one of said markings is behind said window in said panel, said masking member being adapted to be moved to said second position as said stroke result indicating member is moved to said stop position whereby said one marking will be visible.

2. Apparatus according to claim 1, wherein said stroke simulating means is adapted to enable manual rotation of said stroke result indicating member from any of a plurality of positions to said stop position.

3. Apparatus according to claim 2, wherein said stroke simulating means comprises an arcuate slot in said panel and a plurality of holes, corresponding to the number of said markings, spaced around said stroke result indicator member on radii the same as that of said slot whereby some of said holes will be accessible through said slot, whereby said stroke result indicator member can be rotated by engaging a suitable implement with any one of said accessible holes and swinging said implement along said slot to an end thereof, contact of said implement with said end of said slot defining said stop position, said masking member partially obstructing said slot in its first position and being contacted and moved by said implement to its second position as said implement is moved to said end of said slot.

4. Apparatus according to claim 1, wherein said masking member has thereon a marking representing a golf ball, said marking being behind said window in said panel when said masking member is in said first position.

5. Apparatus according to claim 4, wherein said masking member is movable to a third position in which it masks said window in said panel and has thereon two said markings of which one represents a golf ball in a "tee" position and the other a golf ball in the "lie" position, a respective one of said two markings being behind said window in said panel when said masking member is in said first and third positions.

6. Apparatus according to claim 1, including a club selector member having therein a plurality of windows and movable between a corresponding plurality of positions in each of which a respective one of said plurality of windows is behind said window in said panel to permit vision only through a a corresponding radial portion of said window in said panel, said stroke result indicator member having a corresponding plurality of radially spaced sets of said markings, whereby when said masking member is in said second position the marking visible will be of a said set determined by the position of said club selector member.

7. Apparatus according to claim 1, wherein said markings represent the results of a stroke in increments of positional error over or short of and to the left or right of a selected target position.

8. Apparatus according to claim 7, wherein said markings indicate positional error in from 0 to 2 increments over or short and from 0 to 2 increments left or right.

9. Apparatus according to claim 7, including distance setting means enabling selection of said target position in terms of a distance from a starting position.

10. Apparatus according to claim 1, in combination with a representational reproduction of at least part of a golf course.

11. A combination according to claim 10, wherein, for the or each hole, said representation of said golf course is provided with markings indicating the distance from a teeing-off position to the green.

* * * * *